US008985802B2

(12) United States Patent
Nievas

(10) Patent No.: US 8,985,802 B2
(45) Date of Patent: Mar. 24, 2015

(54) ILLUMINATED CANE

(76) Inventor: Miguel Angel Nievas, Jackson Heights, NY (US)

( * ) Notice: Subject to any disclaimer, the term of this patent is extended or adjusted under 35 U.S.C. 154(b) by 2 days.

(21) Appl. No.: 14/005,837

(22) PCT Filed: Mar. 23, 2012

(86) PCT No.: PCT/EC2012/000018

§ 371 (c)(1),
(2), (4) Date: Sep. 18, 2013

(87) PCT Pub. No.: WO2012/136228

PCT Pub. Date: Oct. 11, 2012

(65) Prior Publication Data

US 2014/0009915 A1 Jan. 9, 2014

(30) Foreign Application Priority Data

Apr. 4, 2011 (AR) ..... M20110101123

(51) Int. Cl.

| | |
|---|---|
| ***A45B 3/02*** | (2006.01) |
| ***A45B 3/04*** | (2006.01) |
| ***A45B 3/12*** | (2006.01) |
| *A61H 3/06* | (2006.01) |

(52) U.S. Cl.

CPC ... *A45B 3/04* (2013.01); *A45B 3/02* (2013.01); *A45B 3/12* (2013.01); *A61H 3/068* (2013.01); *A61H 2201/0161* (2013.01); *A61H 2201/0188* (2013.01); *A61H 2201/0192* (2013.01); *A61H 2201/5048* (2013.01)

USPC ..... 362/102; 362/184; 135/75

(58) Field of Classification Search

CPC ..... A45B 3/02; A45B 3/12; A45B 3/04; F41B 15/025

USPC ..... 362/102, 184; 135/75

See application file for complete search history.

(56) References Cited

U.S. PATENT DOCUMENTS

| | | | | | |
|---|---|---|---|---|---|
| 3,987,807 | A * | 10/1976 | Varnell | 135/66 |
| 5,586,957 | A * | 12/1996 | Wilkinson | 482/74 |
| 5,845,664 | A * | 12/1998 | Ryder et al. | 135/65 |
| 8,397,737 | B2 * | 3/2013 | Evans et al. | 135/65 |
| 2006/0090783 | A1 * | 5/2006 | King-Fai | 135/67 |
| 2013/0271966 | A1 * | 10/2013 | Doble | 362/183 |

FOREIGN PATENT DOCUMENTS

| | | |
|---|---|---|
| CN | 201663976 | 12/2010 |
| CN | 201759812 | 3/2011 |
| DE | 3110135 | 10/1982 |
| WO | WO9800088 | 1/1998 |

* cited by examiner

*Primary Examiner* — Peggy Neils

(74) *Attorney, Agent, or Firm* — Defillo & Associates, Inc.; Evelyn A. Defillo

(57) ABSTRACT

An illuminated walking cane including a handle, a pole, and a rubber tab on the distal end of the pole. The handle includes a compartment for at least one battery connected through an electric circuit to a plurality of luminous sources. The luminous sources are placed in different heights on the inside of the cane. The cane also contains a series of tubular extended pieces that enlarge and shorten by fitting one into the other, in telescopic action. An automatic trigger mechanism allows the cane to be both retractile and protractile.

3 Claims, 4 Drawing Sheets

ILLUMINATED CANE

CROSS REFERENCE TO RELATED APPLICATION

This application is a national stage entry of PCT/EC2012/000018 filed Mar. 23, 2012, under the International Convention and claiming priority over Argentinean Patent Application No. 20110101123 filed Mar. 4, 2011.

TECHNICAL FIELD OF THE INVENTION

The following invention refers to a illuminated walking cane that works as an aid for people that either need a supplementary balancer due to health conditions, or just look for comfort purposes. In the first case, we include blind people, old people, convalescents, the injured, amputees, etc. In the second case, it could be used by mountaineers, pedestrians, etc.

BACKGROUND OF THE INVENTION

Generally speaking, and as it is known already, it is a serious problem for people that need a walking cane to walk (especially in metropolis and urban areas, and in roads and highways with lots of traffic), where they might be run over or experience a fall.

The expressed problem has led to think that the solution has to do with the supply of a illuminated walking cane, being illuminated throughout its length, thereby becoming a marker device of the presence of its holder to others.

We should start with the present state and previous art of the technique, by mentioning that the main goal of the invention is based on a illuminated walking cane", provided with the means to achieve luminosity, which can be activated by its user. It contains sounds as well, responding to electric pulses, that are determined by their handler, keeping safe the physical integrity of the user and others, improving their lifestyle at a very low cost.

We can also point out the simplicity of usage of the device, which is mainly commanded by push-buttons for determining the effect achieved by the cane.

It will be clear the way in which these and others objectives and advantages of the invention are reached in practice, more clearly, referring to the detailed description that follows. We have some examples, in no way limiting, of the preferred developments of the invention, and also of the pictures that follow, in which:

DETAILED DESCRIPTION OF THE INVENTION

Figure 1:
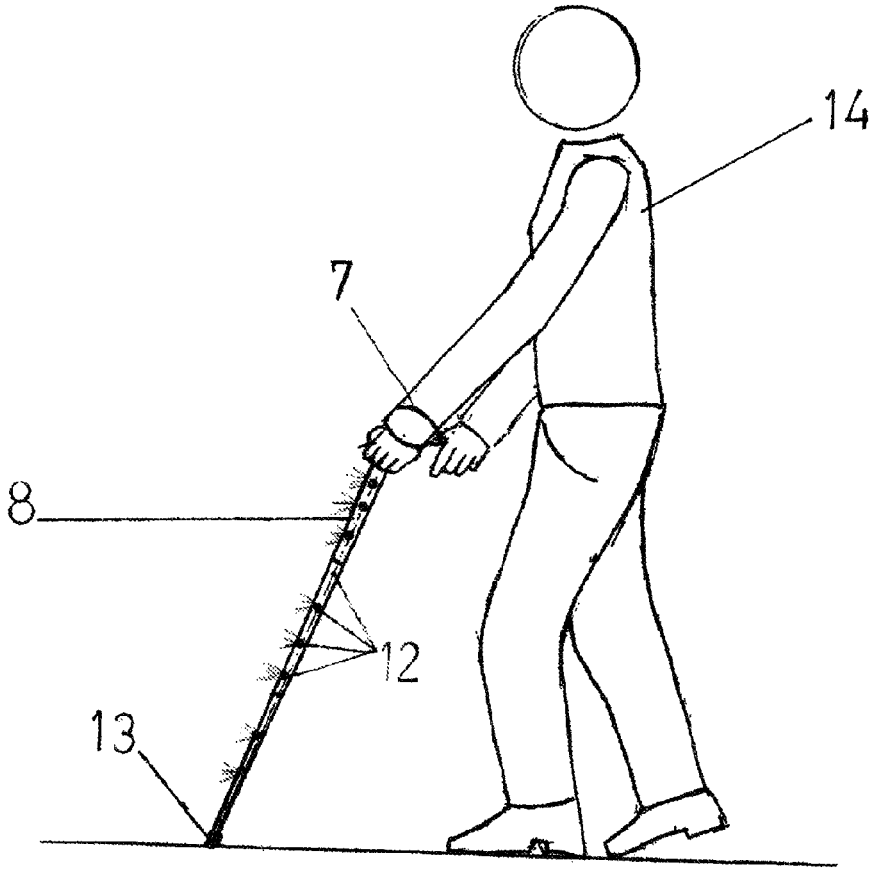
FIG. 1, is a schematic view of the luminous cane in a protractile way of use.
Figure 2:
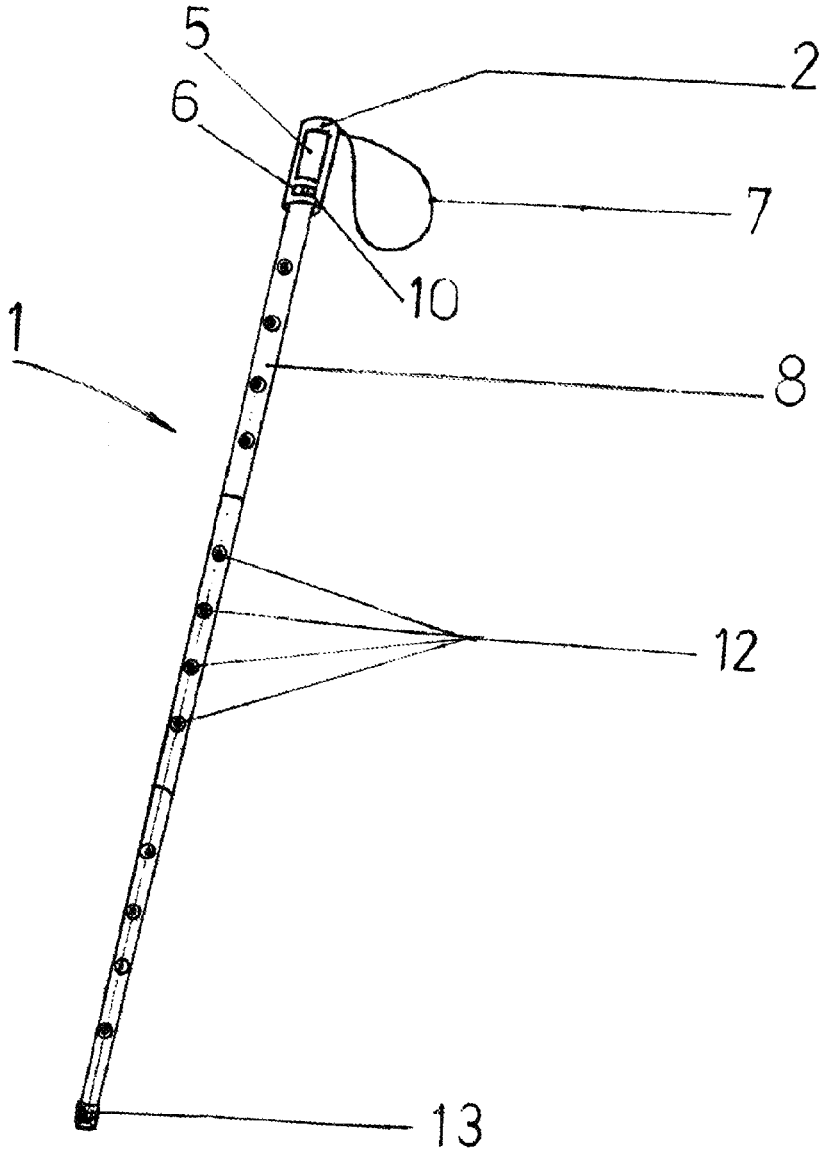
FIG. 2, is a schematic view of the cane itself, with all its components.
Figure 3:
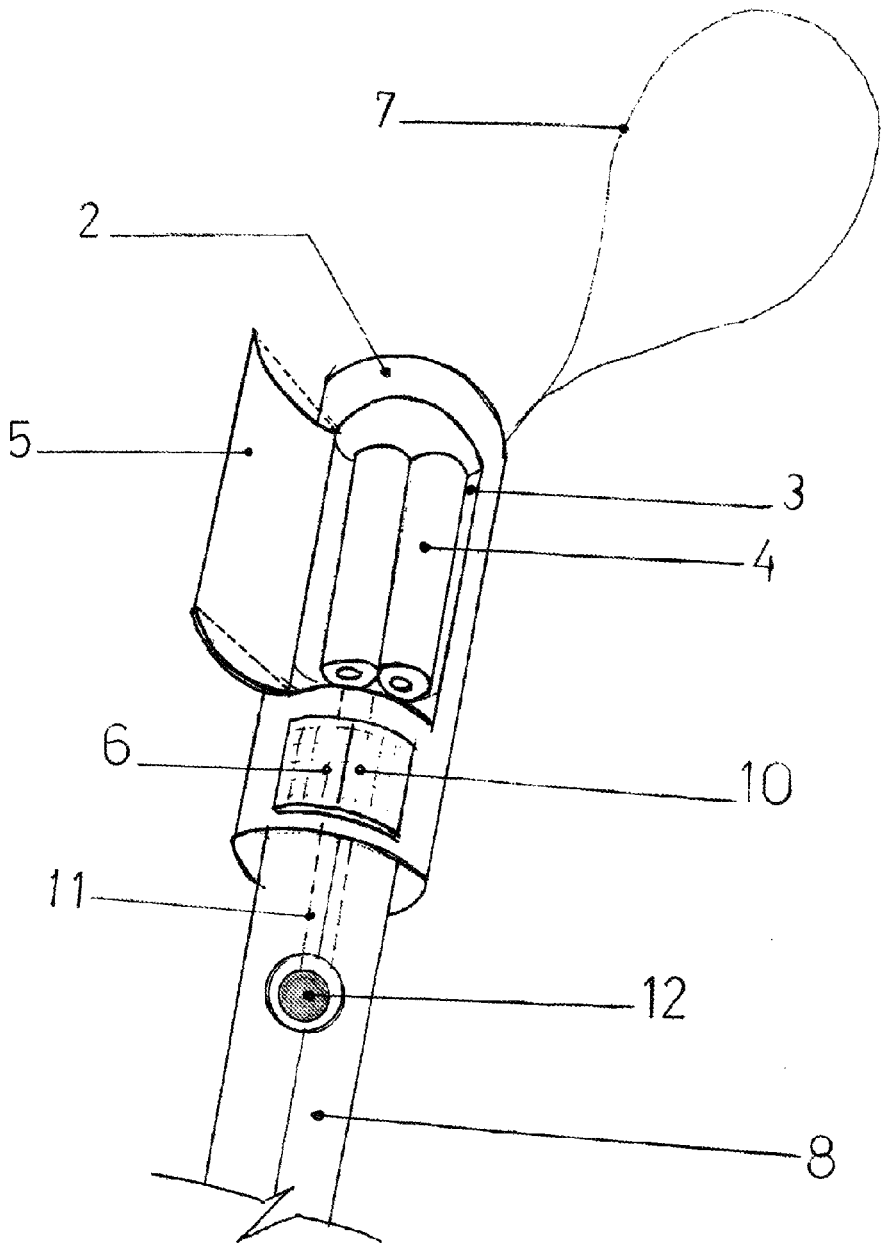
FIG. 3, is a schematic view of the cane, particularly its handle.
Figure 4:
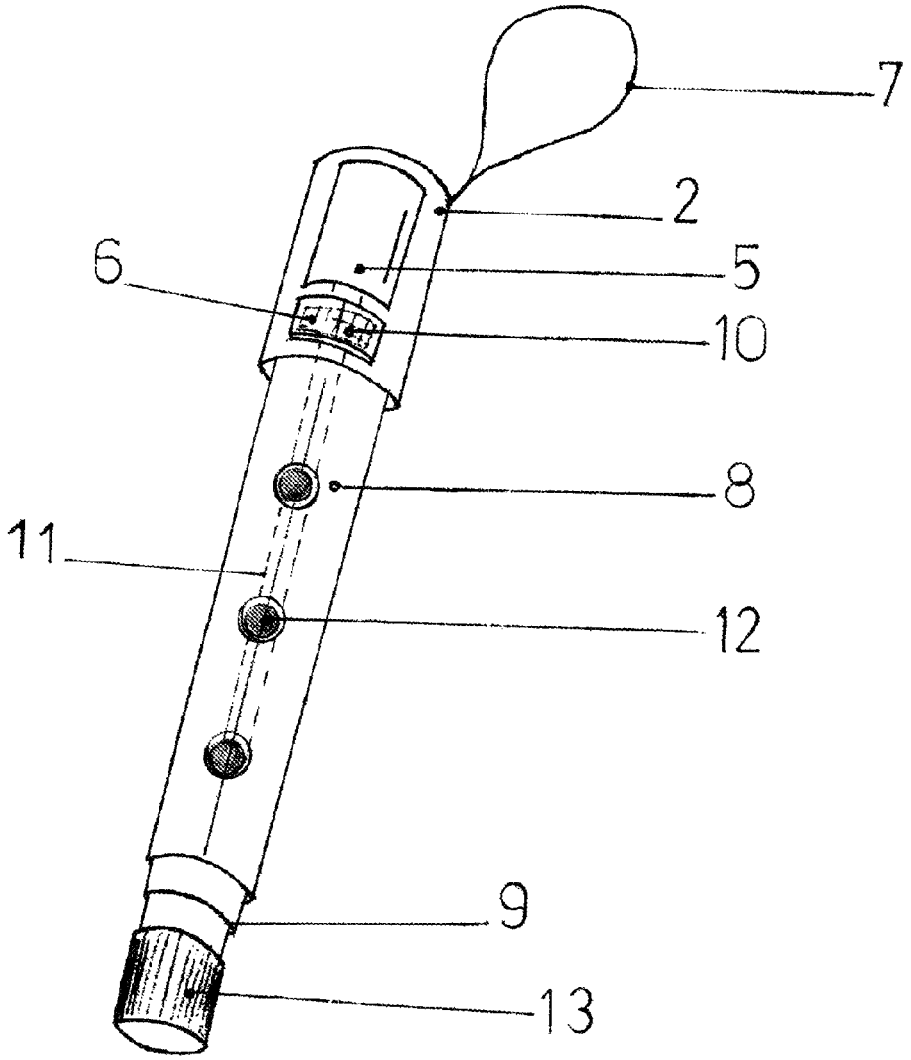
FIG. 4, is a schematic view in a withdrawn position.

In all the figures, the same reference numbers indicate equal or corresponding elements. These are:

1. Walking Cane.
2. Cane handle.
3. Battery compartment.
4. Battery.

5. Closure cap of the compartment (3).
6. Button power switch.
7. Clip cord, or leather clasp for the hand of the user.
8. Cane pole.
9. Telescopic cylindrical trunks forming the cane (8).
10. Power switch to command the discharge of the cylindrical trunks (9).
11. Conductors.
12. Electric bulbs.
13. Rubber tap.
14. User.

The cane pole component 8 is made of a conductor of light material. It could be translucent, carbon fiber, methacrylate, polycarbonate, optical fiber, glass, plastic, or any other material that conducts light or is transparent or translucid. Also, the cane pole 8 is hollow, so as to allow the placement of at least one luminous source.

The luminous source includes a lamp, light bulb, or electric resistance, fed by interchangeable batteries, activated by alternating or direct current, solar or other energy. Luminous diode LEDs could also be used.

The luminous device includes an electric circuit supply with energy, built in the inside of the cane, lengthways. Through a power switch, the energy is activated, so as to convey light in the inside and outside of the cane, as a means of luminosity, similar to little light bulbs or electric torches, for the sightless.

The hookup between lamps or bulbs and the battery is done through the conductors of electricity. One of them contains a power switch, that allows to open and close the circuit at will.

It is very important to highlight the fact that the pole cane is made by a series of extended tubular pieces that expand and shorten by fitting one another, in telescopic action. And that they also contain an automatic trigger mechanism through a power switch, so that the cane can be either retractile or protractile.

According to the above and illustrated information, it is easy to understand the advantages of practical order that the illuminated walking cane provides. This way, the claims that follow, cover the range of the invention.

Having described and determined the nature of the invention already, and the way in which it can be put into practice in its main idea, what follows is declared to be claimed as an invention and exclusive property:

What is claimed is:

1. An illuminated walking cane comprising:
a handle and
a pole having a first end and a second end, the first end of the pole connected to the handle;
a rubber tap connected to the second end of the pole;
a compartment located inside the handle, the compartment including at least one battery connected through an electric circuit to a plurality of luminous sources in different heights through a length of the pole, the luminous sources are placed inside the pole;
a power switch connected to the handle, the power switch is operatively connected to the at least one battery, activating the power switch causes the luminous source to light up;
the pole includes a plurality of telescopic tubular pieces that enlarge and shorten the length of the pole,
an automatic trigger system connected to a power switch, the automatic trigger system automatically extend and retracts the length of the pole.

2. The illuminated walking cane according to claim 1, further including a closure cap for the compartment.

3. The illuminated walking cane according to claim 1, further including a cord or a clasp secured to the handle.

* * * * *